US008585417B2

(12) United States Patent
Chien

(10) Patent No.: US 8,585,417 B2
(45) Date of Patent: Nov. 19, 2013

(54) TOP LATCHING ASSEMBLY AND CONNECTOR

(75) Inventor: Shin-Hao Chien, New Taipei (TW)

(73) Assignee: Kemax Shing Co., Ltd., New Taipei (TW)

( * ) Notice: Subject to any disclaimer, the term of this patent is extended or adjusted under 35 U.S.C. 154(b) by 147 days.

(21) Appl. No.: 13/286,672

(22) Filed: Nov. 1, 2011

(65) Prior Publication Data

US 2013/0109216 A1 May 2, 2013

(51) Int. Cl.
*H01R 13/62* (2006.01)

(52) U.S. Cl.
USPC ..... 439/157; 439/327; 361/801

(58) Field of Classification Search
USPC ..... 439/157–160, 325–328
See application file for complete search history.

(56) References Cited

U.S. PATENT DOCUMENTS

| | | | | | |
|---|---|---|---|---|---|
| 5,726,865 | A * | 3/1998 | Webb et al. | ..... | 361/801 |
| 5,746,613 | A * | 5/1998 | Cheng et al. | ..... | 439/157 |
| 5,980,282 | A * | 11/1999 | Cheng | ..... | 439/157 |
| 6,064,574 | A * | 5/2000 | Yu et al. | ..... | 361/704 |
| 6,219,251 | B1 * | 4/2001 | Wang | ..... | 361/752 |
| 7,500,863 | B2 * | 3/2009 | Ringler et al. | ..... | 439/327 |

* cited by examiner

*Primary Examiner* — Tho D Ta
*Assistant Examiner* — Larisa Tsukerman
(74) *Attorney, Agent, or Firm* — Jackson IPG PLLC

(57) ABSTRACT

A top latching assembly includes a main body, a lug disposed on at least one side of the main body, a first elastic arm extended from an external side of the main body for carrying the lug, and a second elastic arm extended from an external side of the main body and disposed opposite to the top of the first elastic arm, and each second elastic arm can interfere with each first elastic arm to be apart from or proximate to the main body, such that the top latching assembly can latch a corresponding circuit board into the connector, so as to enhance the reliability of an electric connection between the connector and the circuit board.

11 Claims, 10 Drawing Sheets

TOP LATCHING ASSEMBLY AND CONNECTOR

BACKGROUND OF THE INVENTION

1. Field of the Invention

The present invention relates to a top latching assembly and connector thereof, in particular to a top latching assembly and connector for circuit board to be stable under any circumstance that further increases electrical connection reliability between connector and circuit board.

2. Description of the Related Art

Refer to U.S. Pat. Nos. 5,680,463 and 5,746,614 for known prior art, and with reference to FIG. 1, an edge connector 7 with ejection device 8 includes log insulated body 9 with a slot 90 for corresponding circuit board (not shown in Fig.). Two corresponding guiding walls 91 are on the long side of the insulated body 9, a concave slot 93 is between the guiding walls 91, and a joint hole 92 is in the guiding wall 91. The ejection device 8 is within the concave slot 93 and contains a pair of corresponding side walls 80; every side wall 80 has a joint axis 81 to connect to the joint hole 92. By rotating joint axis 81 in the joint hole 92, the ejection device 8 can be moved out to ejection position from vertical position, and push out the circuit board inside the slot 90. A convex 82 wedged with guiding walls 91 is installed in the side wall 80 to fasten ejection device 8 in the holding position. A thin slot 83 is between the side walls 80 of the ejection device 8 to increase the flexibility of the ejection device 8, and easier to join the convex 82 and guiding walls 91 during assembly.

However, the ejection device 8 of known edge card connector is fastened on the holding position by the joint of the convex 82 and guiding walls 91, a vertical force pushes on the ejection device 8 can make it out of holding position; when the edge card connectors applied similar mechanism under vibration or being touched carelessly, the ejection device 8 can be easily moved from holding position and ejected out, that influences electrical connection reliability of car edge and circuit board.

SUMMARY OF THE INVENTION

In view of the aforementioned problems of the prior art, it is a primary objective of the present invention to provide a top latching assembly and connector thereof, capable of holding circuit board under any circumstance without falling and increases electrical connection reliability between connector and circuit board.

To achieve the foregoing objective, the present invention provides a top latching assembly comprises a main body, a lug disposed on at least one side of the main body, a first elastic arm extended from an external side of the main body for carrying the lug, and a second elastic arm extended from an external side of the main body and disposed opposite to the top of the first elastic arm; a support area facing down is on the end of the second elastic arm, a corresponding pressure area is on top of the support area, the pressure area is hung on top of the main body and is connected to both sides of the second elastic arm, the pressure area controls the support area and interferes the first elastic arm apart from or proximate to the main body, such that the top latching assembly can latch a corresponding circuit board into the connector, so as to enhance the reliability of an electric connection between the connector and the circuit board.

DETAILED DESCRIPTION OF THE PREFERRED EMBODIMENTS

The technical content of the present invention will become apparent by the detailed description of the following embodiments and the illustration of related drawings as follows.

Figure 1:
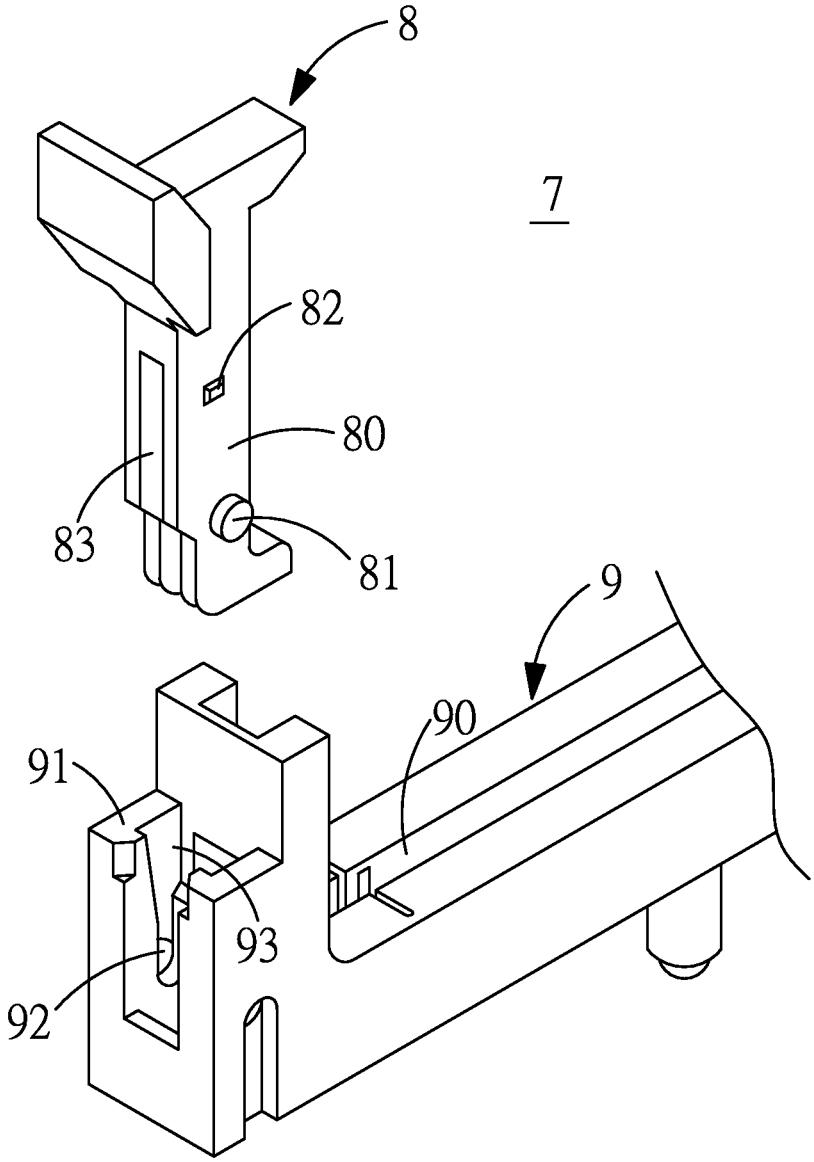
FIG.1 PRIOR ART
FIG. 1 is an assembly view of a connector of prior art.
Figure 2:
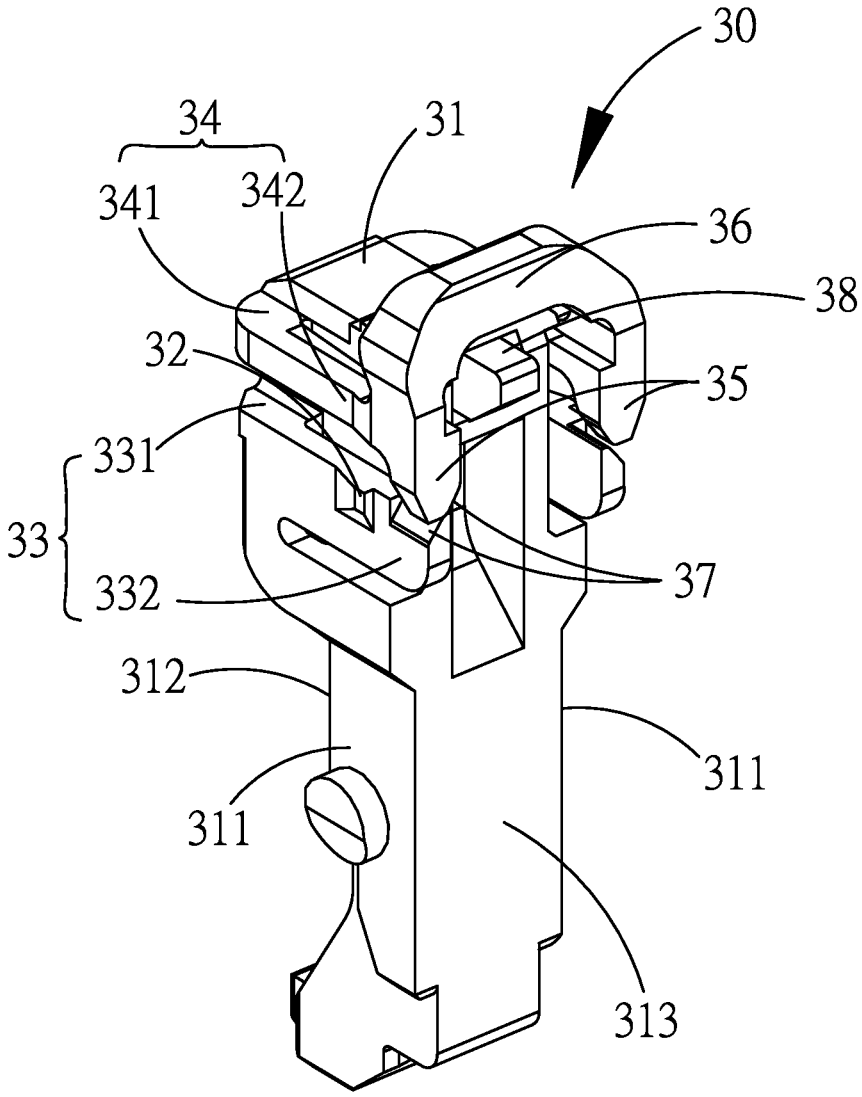
FIG. 2 is a perspective view of top latching assembly in accordance with a preferred embodiment of the present invention.
Figure 3:
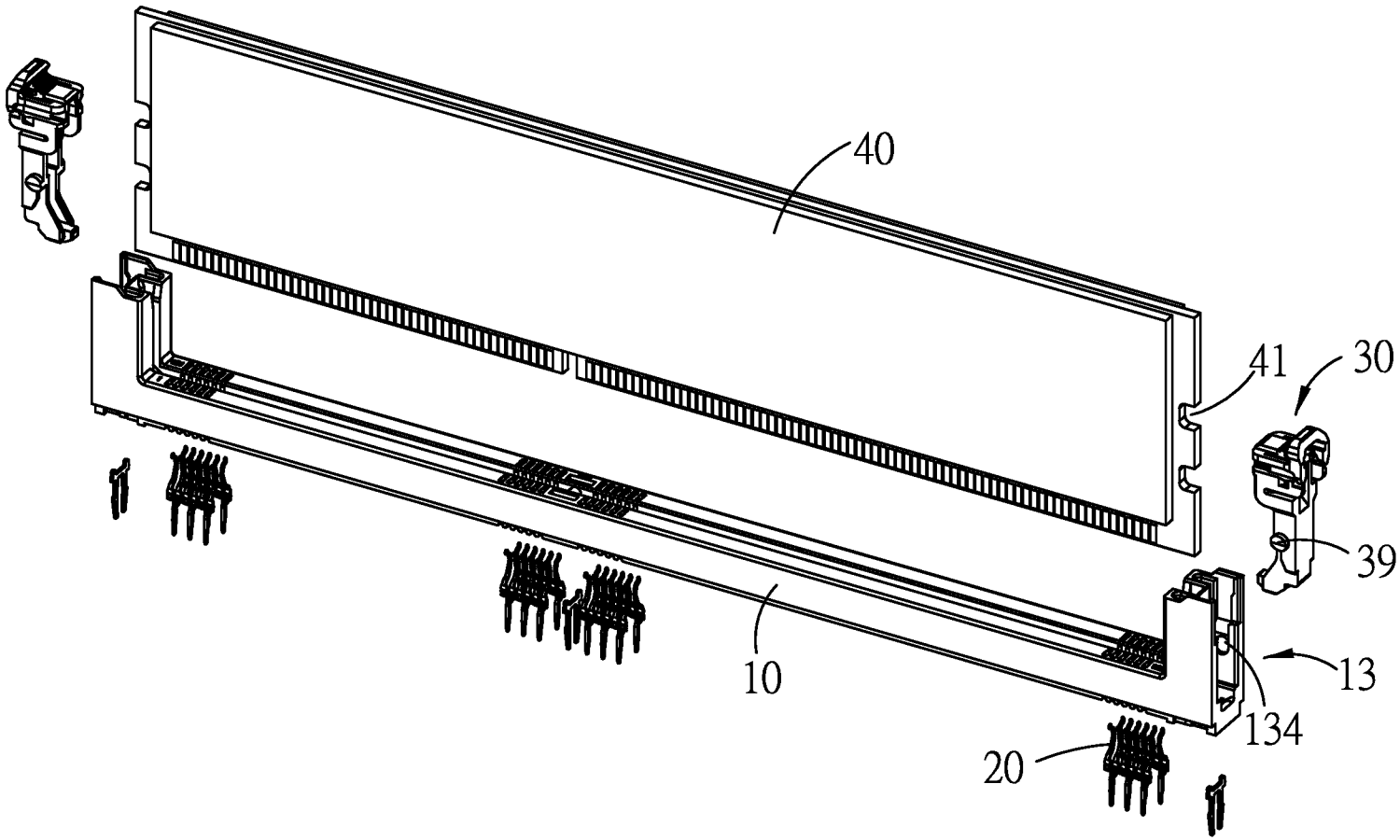
FIG. 3 is an assembly view of the present invention.

With reference to FIG. 2, the top latching assembly 30 of the present invention comprises a main body 31, a side wall 311 each is on one side of the main body 31, a front wall 312 and a rear wall 313 connect two side walls 311, and a lug 32 disposed on at least one side of the main body 31. As shown in figures, in this preferred embodiment, two lugs 32 are on each side of the main body 31, a first elastic arm 33 extended from an external side of the main body 31 for carrying the lug 32, and a second elastic arm 34 on top of the first elastic arm 33 extended from an external side of the main body 31; the first and second elastic arms 33, 34 stretch from front wall 312 to rear wall 313; the first and second elastic arms 33, 34 consist of fastener ends 331, 341 on top of the main body 31 and elastic ends 332, 342 hung on external side of the main body 31; the lug 32 locates on the elastic end 332 of the first elastic arm 33.

A support area 35 facing down is on the end of the second elastic arm 34, a corresponding pressure area 36 is on top of the support area 35, the pressure area 36 is hung on top of the main body 31 and is connected to both sides of the second elastic arm 34, the pressure area 36 controls the support area and interferes the first elastic arm 33 apart from or proximate to the main body 31; the lug 32 is protruding on the first elastic arm 33; a blocking plane 321 near one side of the pressure area 36 is formed on the lug 32.

Figure 4:
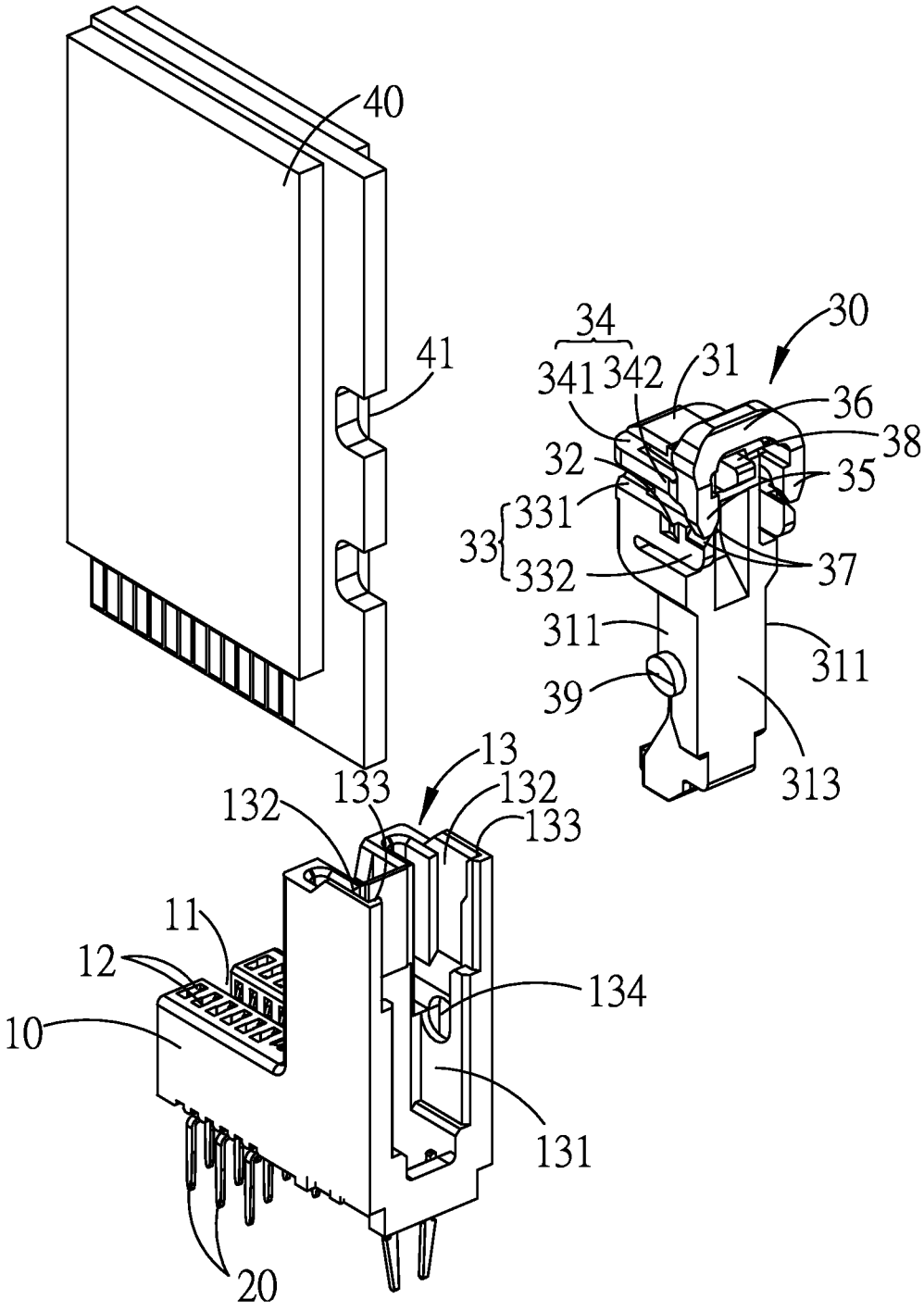
FIG. 4 is a partial assembly view of the present invention.

The top latching assembly 30 of the present invention can latch corresponding circuit board on connector stably, as shown in FIG. 4 and FIG. 5; the connector of the present invention comprises an insulated body 10 and a plurality number of conductive tips 20; a slot 11 is on top of the insulated body 10, a plurality number of tip slots 12 are on the slot 11, towers 13 are on both sides of the tip slots 12, a container 131 with inner walls 132 on both sides of the tower 13, a stop plane 133 toward container 131 is formed inside the inner wall 132, connection holes 134 are inside the inner wall 132; a plurality number of conductive tips 20 are installed inside the plural tip slots 12.

Figure 5A:
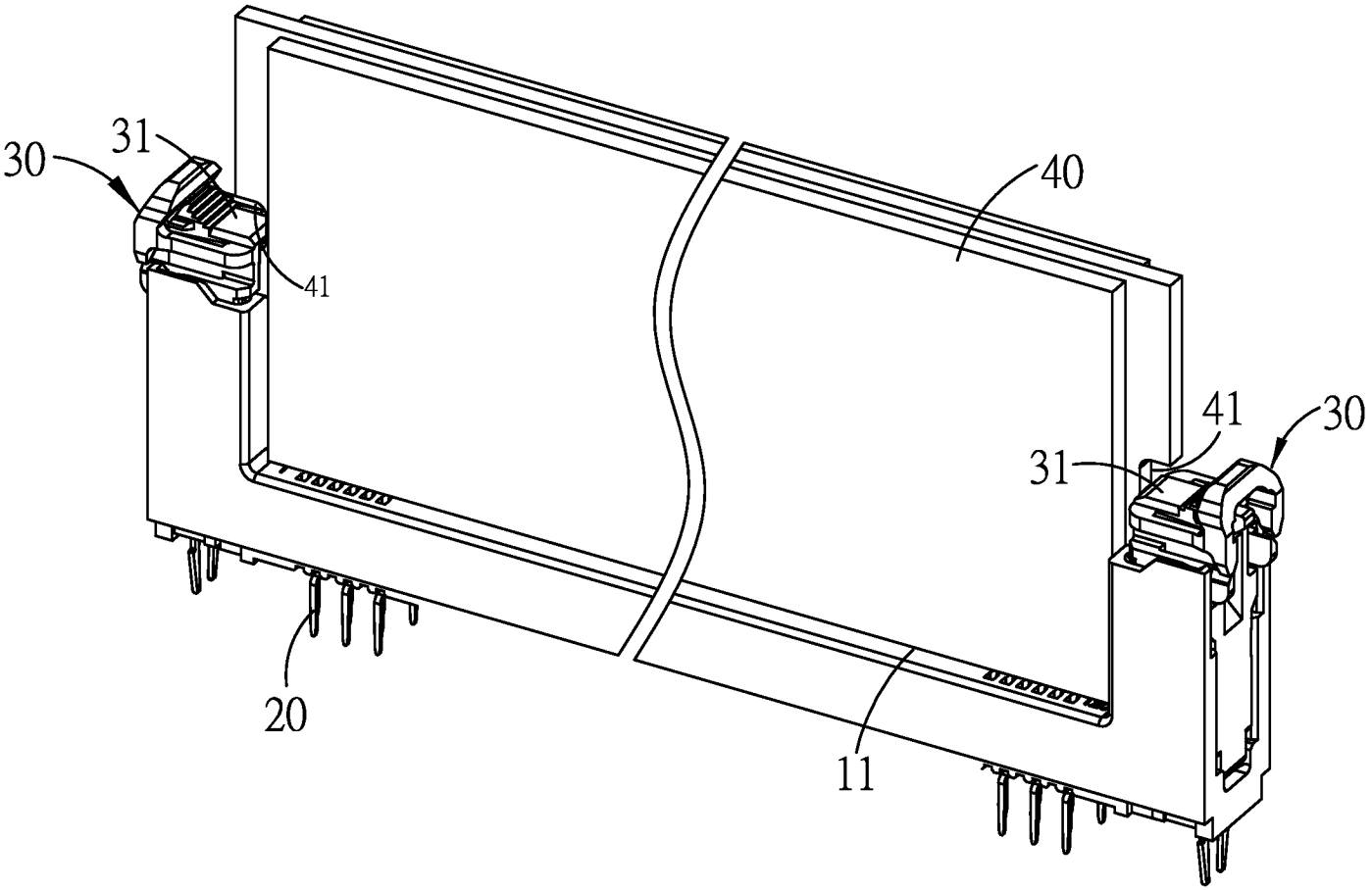
FIG. 5A is another perspective view of the present invention.
Figure 5B:
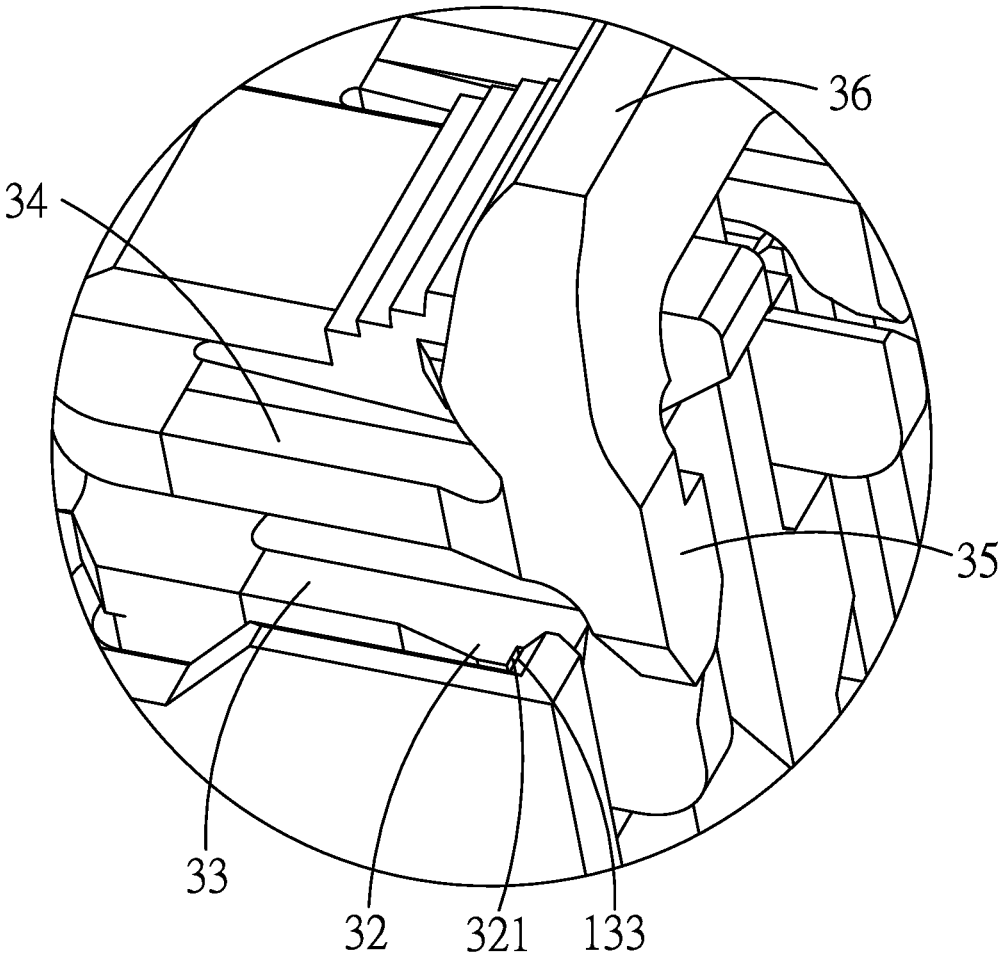
FIG. 5B is an operational view of top latching assembly in latching position in accordance with a preferred embodiment of the present invention.

The top latching assembly 30 of the present invention further consists of pivots 39 each on both sides of side walls 311 to connect to connection holes 134. Refer to FIGS. 5A and 5B; wile assembly, users insert circuit board 40 into slot 11 and have circuit board 40 electrically connect to conductive tips 20, then rotate top latching assembly 30 to latch the main body 31 to the corresponding gaps 41 on both sides on the circuit board 40 to have circuit board 40 stable inside the slot 11. The blocking plane 321 on the lug 32 stops the stop plane 133 and the top latching assembly 30; the circuit board 40 cannot rotate from latching position to pull-up position. When connector vibrates or is stricken accidentally, the top latching assembly 30 remains firmly to keep the circuit board 40 in slot 11 stably without falling, and assures the circuit board 40 maintain electrical connection with the connector.

Figure 6A:
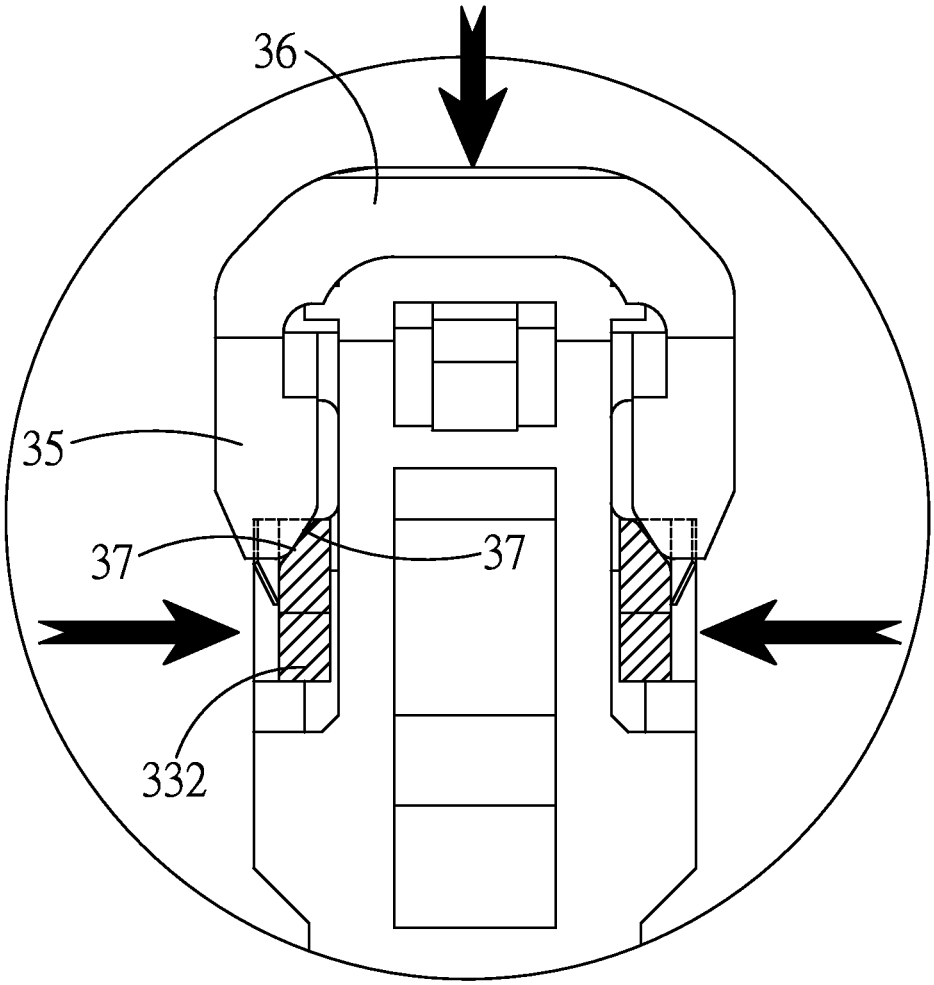
FIG. 6A is an operational view of top latching assembly rotates from latching position in accordance with a preferred embodiment of the present invention.
Figure 6B:
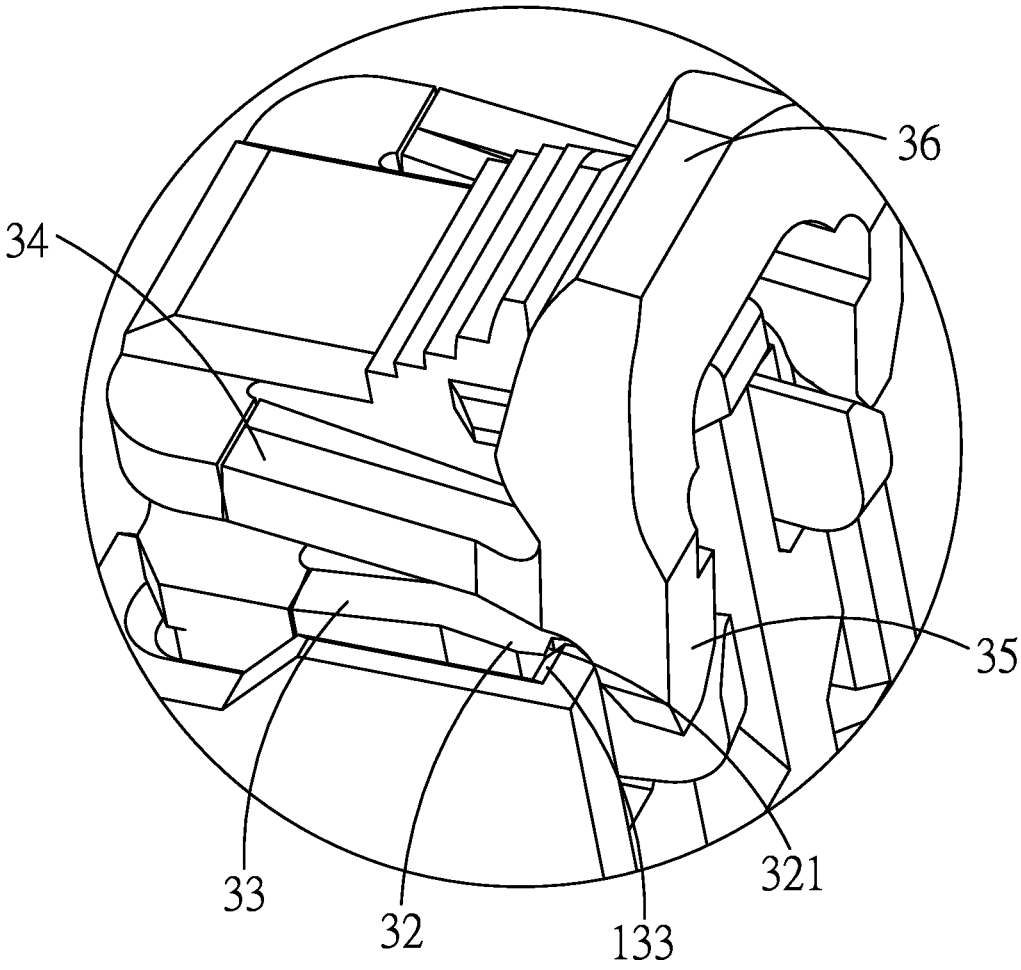
FIG. 6B is another operational view of top latching assembly rotates from latching position in accordance with a preferred embodiment of the present invention.
Figure 6C:
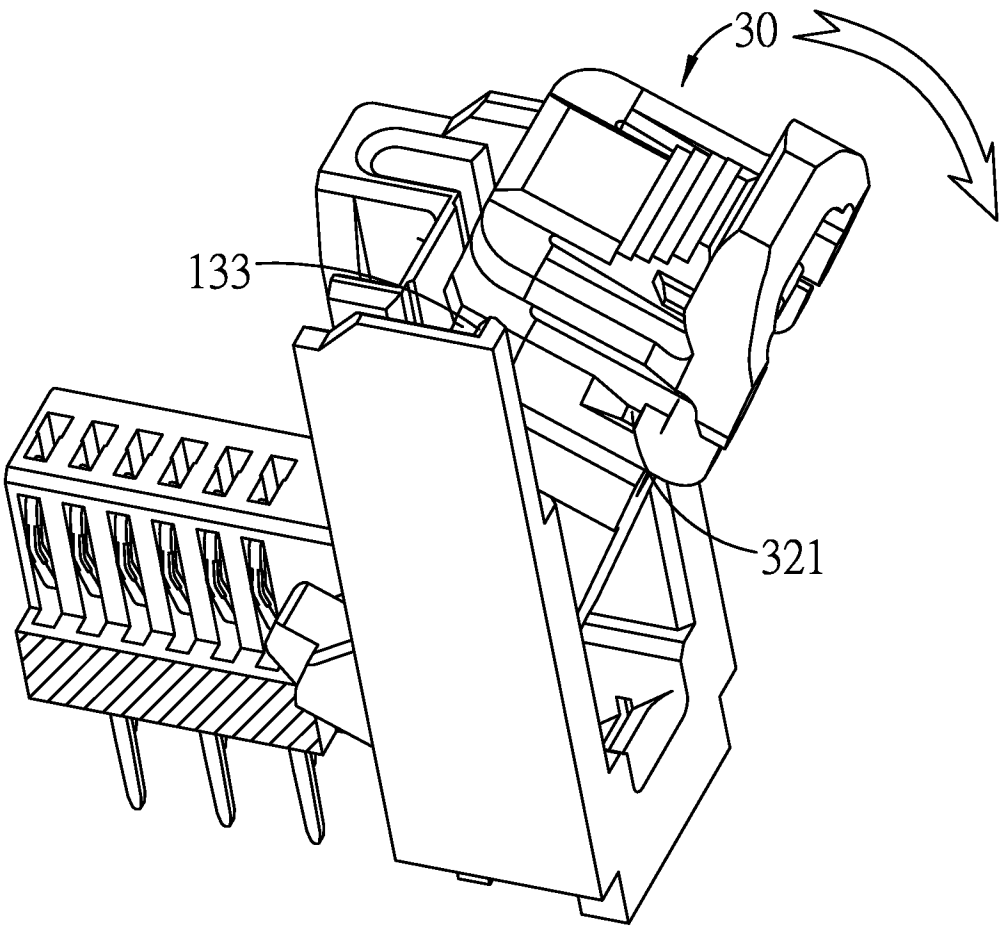
FIG. 6C is third operational view of top latching assembly rotates from latching position in accordance with a preferred embodiment of the present invention.
Figure 7:
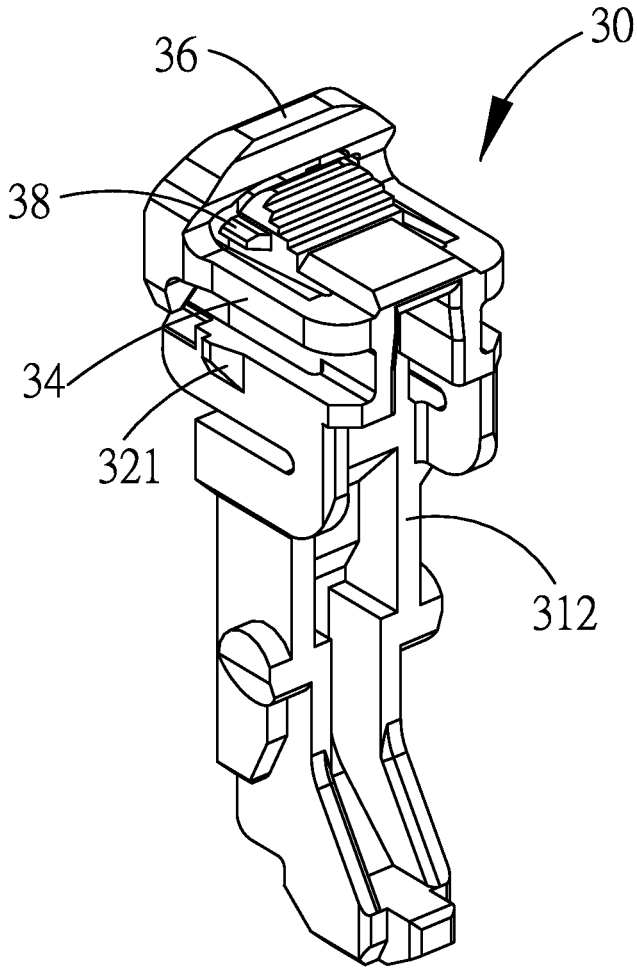
FIG. 7 is another perspective view of top latching assembly in accordance with a preferred embodiment of the present invention.

While taking out the circuit board 40, refer to FIGS. 6A and 6B, users push down the pressure area 36 of the second elastic arm 34 on the main body 31 to control the support area 35 and keep the elastic ends 332 of the first elastic arm 33 away from the main body 31, also control the stop plane 321 of the lug 12 leave or stop on the blocking plane 133, then rotate the top latching assembly 30 toward pull-up position, as shown in 6C, finally top out the circuit board 40 from the connector.

Furthermore, an oblique guide surface 37 with guiding function is formed between the elastic end 332 of the first elastic arm 33 and each support area 35, as shown in FIG. 6A; a blocking piece 38 with space limitation function is formed on top of the main body 31 corresponding to the bottom of the pressure area 36, as shown in FIG. 2, to prevent the first elastic arm 33 from breaking downward; another blocking piece 38 is formed on each of the side wall 311 of the main body 31 corresponding the top of the second elastic arm 34 to keep the first elastic arm 33 from breaking upward.

While a preferred embodiment of the invention has been shown and described in detail, it will be readily understood and appreciated that numerous omissions, changes and additions may be made without departing from the spirit and scope of the invention. The present invention discloses a top latching assembly having a main body, a lug disposed on at least one side of the main body, a first elastic arm extended from an external side of the main body for carrying the lug, and a second elastic arm extended from an external side of the main body and disposed opposite to the top of the first elastic arm, and each second elastic arm can interfere with each first elastic arm to be apart from or proximate to the main body, such that the top latching assembly can latch a corresponding circuit board into the connector, so as to enhance the reliability of an electric connection between the connector and the circuit board.

What is claimed is:

1. A top latching assembly comprising
a main body,
a lug disposed on at least one side of said main body,
a first elastic arm extended from an external side of said main body for carrying the lug, and
a second elastic arm extended from an external side of said main body and disposed opposite to the top of said first elastic arm,
a support area facing down is on an end of said second elastic arm,
a corresponding pressure area is on top of said support area,
said pressure area is hung on top of said main body and is connected to both a first side and a second side of said second elastic arm, said first side of said second elastic arm being opposite said second side of said second elastic arm,
wherein a side wall each is on one side of said main body, a front wall and a rear wall connect two said side walls, said first and second elastic arms stretch from said front wall to said rear wall,
wherein said first and second elastic arms consist of fastener ends on top of said main body and elastic ends hung on external side of said main body, said lug locates on said elastic end of said first elastic arm.

2. The top latching assembly of claim 1,
wherein said lug is protruding on said first elastic arm, and a blocking plane near one side of said pressure area is formed on said lug.

3. The top latching assembly of claim 1,
wherein an oblique guide surface is formed between said elastic end of said first elastic arm and each said support area.

4. The top latching assembly of claim 1,
wherein a blocking piece is formed on both a first side and a second side of said main body at a position adjacent said second elastic arm, said first side of said main body being opposite said second side of the said main body.

5. The top latching assembly of claim 1,
wherein a blocking piece is formed on top of said main body corresponding to the bottom of said pressure area.

6. A connector compromising:
an insulated body with a slot on top,
a plurality number of tip slots are on said slot,
towers are on both sides of said tip slots,
a container with inner walls on both sides is in each of said towers,
a stop plane toward container is formed inside said inner wall;
a plurality number of conductive tips are installed inside said plural tip slots;
a top latching assembly is inside said container of said insulated body, and comprises
a main body and lugs disposed on both sides of said main body,
a side wall each is on one side of said main body, a front wall and a rear wall connect two said side walls, said first and second elastic arms stretch from said front wall to said rear wall,
one side of said lug has a blocking plane stops said stop plane,
a first elastic arm extended from an external side of said main body for carrying said lug, and
a second elastic arm extended from an external side of said main body and disposed opposite to the top of said first elastic arm,
said first and second elastic arms consist of fastener ends on top of said main body and elastic ends hung on external side of said main body, said lug locates on said elastic end of said first elastic arm,
said second elastic arm controls said first elastic arm away from or near said main body, also controls said stop plane of said lug leave or stop on the blocking plane.

7. The connector of claim 6, wherein said lug is protruding on said first elastic arm.

8. The connector of claim 6,
wherein a support area facing down is on the end of said second elastic arm to interfere said first elastic arm apart from or proximate to said main body, a corresponding pressure area is on said second elastic arm and hung on top of said main body, said pressure area is connected to both sides of said second elastic arm.

9. The connector of claim 6, wherein a blocking piece is formed on the top of said second elastic arm.

10. The connector of claim 8, wherein an oblique guide surface is formed between said elastic end of said first elastic arm and each said support area.

11. The connector of claim 8, wherein a blocking piece is formed on top of said main body.

* * * * *